US006134521A

United States Patent [19]

Kotzin

[11] Patent Number: 6,134,521

[45] Date of Patent: Oct. 17, 2000

[54] METHOD AND APPARATUS FOR MITIGATING AUDIO DEGRADATION IN A COMMUNICATION SYSTEM

[75] Inventor: Michael Dale Kotzin, Buffalo Grove, Ill.

[73] Assignee: Motorola, Inc., Schaumburg, Ill.

[21] Appl. No.: 08/197,908

[22] Filed: Feb. 17, 1994

[51] Int. Cl.[7] ..... G10L 11/06

[52] U.S. Cl. ..... 704/226

[58] Field of Search ..... 381/29, 36, 43, 381/45–47; 395/2, 2.1, 2.35, 2.3, 2.32, 2.38, 2.43, 2.4, 2.2, 2.21, 2.28; 370/79–80, 84; 379/58, 88, 89

[56] References Cited

U.S. PATENT DOCUMENTS

| | | | |
|---|---|---|---|
| 4,388,491 | 6/1983 | Ohta et al. | 395/2.43 |
| 4,455,649 | 6/1984 | Esteban et al. | 370/80 |
| 4,589,130 | 5/1986 | Galand | 395/2.38 |
| 4,696,040 | 9/1987 | Doddington et al. | 394/2.43 |
| 4,790,015 | 12/1988 | Callens et al. | 395/2.21 |
| 4,860,355 | 8/1989 | Copperi | 381/36 |
| 4,912,766 | 3/1990 | Forse | 381/45 |
| 4,965,789 | 10/1990 | Bottau et al. | 370/79 |
| 5,115,429 | 5/1992 | Hluchyj et al. | 370/84 |
| 5,293,450 | 3/1994 | Kane et al. | 395/2.35 |
| 5,307,460 | 4/1994 | Garten | 395/2.28 |
| 5,317,672 | 5/1994 | Crossman et al. | 395/2.38 |
| 5,371,853 | 12/1994 | Kao et al. | 395/2.32 |

OTHER PUBLICATIONS

*Transmission Quality of Interconnected Networks,* CCITT Experts' Group Meetings on 8 kbit/s & 16 kbit/s Speech Coding, International Telegraph and Telephone Consultative Committee (CCITT), London, Mar. 29–30, 1993, pp. 1–6.

Gan et al, "Adaptive silence deletion for speech storage and voice mail"; IEEE Transactions on Signal Processing, vol. 36, iss. 6, p.924–927, Jun. 1988.

Jayant, "High quality coding of telephone speech and wide-band audio"; IEEE International Conference on Communications ICC '90 Including Supercomm Technical Sessions, p. 927–31 vol. 3, 16–19 Apr. 1990.

Xydeas, "An overview of speech coding techniques"; IEEE Colloquium on 'Speech Coding—Techniques and Applications', p. 111–25, Apr. 14, 1992.

Drogo et al, "Some experiments of 7 khz audio coating at 16 kbits/s"; ICASSP–89, p. 192–5 vol. 1, May 23–26, 1989.

*Primary Examiner*—Tariq R. Hafiz
*Attorney, Agent, or Firm*—Richard A. Sonnentag; L. Bruce Terry

[57] ABSTRACT

Audio degradation is minimized in scenarios where tandem coding occurs. One such scenario is in the environment of voice mail service. Characteristics of an audio information signal are determined, and the signal is classified as to whether further coding should be performed and, if so, which rate/type of coding should be performed. Characteristics of the audio signal which are determined are, inter alia, quality characteristics, rate of previous coding, type of previous coding and the source of previous coding of the audio information signal. The source of previous coding determined may further include, inter alia, an analog network, a digital network, a PSTN or a wireless communication system. Based on this information, the voice mail service will either choose not to further code the audio information signal or code the audio information signal with the best coding algorithm available.

16 Claims, 2 Drawing Sheets

METHOD AND APPARATUS FOR MITIGATING AUDIO DEGRADATION IN A COMMUNICATION SYSTEM

FIELD OF THE INVENTION

The invention relates generally to communication systems and more specifically to mitigating audio degradation in such communication systems.

BACKGROUND OF THE INVENTION

It is well known to use speech coding in communication systems to reduce the bandwidth required for the transmission of speech. In wireless communication systems, and more specifically cellular radiotelephone systems, speech coding rates less than 16 kbps are generally used The achievable quality of these coders is somewhat less than "toll quality" which is basically that level of quality given by typical land-line telephone systems where speech is coded at 64 kbps. Generally, as speech coding rates decrease, the level of quality correspondingly decreases.

In wireless communication systems, the measure of quality of a particular type/rate of speech coder is given by a mean opinion score (MOS). The MOS is a subjective scoring system, having a scoring range between 1–5 or between poor to excellent. A listener rates the particular type/rate coder between the ranges when compared to other types/rates of coders. The higher the rating, the better the speech sounded to the listener.

In cellular radiotelephone systems, and more particularly digital cellular radiotelephones systems, tandem speech coding scenarios will exist at certain times. In tandem speech coding scenarios, a speech input signal is not coded only once, but may be coded twice or more. A common example is when a cellular mobile user desires to leave or retrieve a message on a voice mail system. Not only does the cellular system code the speech input, but the voice mail system may likewise code the speech input signal according to the same or different algorithm. In an example of such a tandem speech coding scenario, where a tandem coding of two vector sum-excited linear predictive (VSELP) speech coders is utilized, the MOS score is reduced from 3.85 for single coding to 3.13 for tandem coding. Thus a need a exists for a method and apparatus for coding speech which reduces excessive degradation in tandem speech coding scenarios.

DETAILED DESCRIPTION OF THE PREFERRED EMBODIMENT

Figure 1:
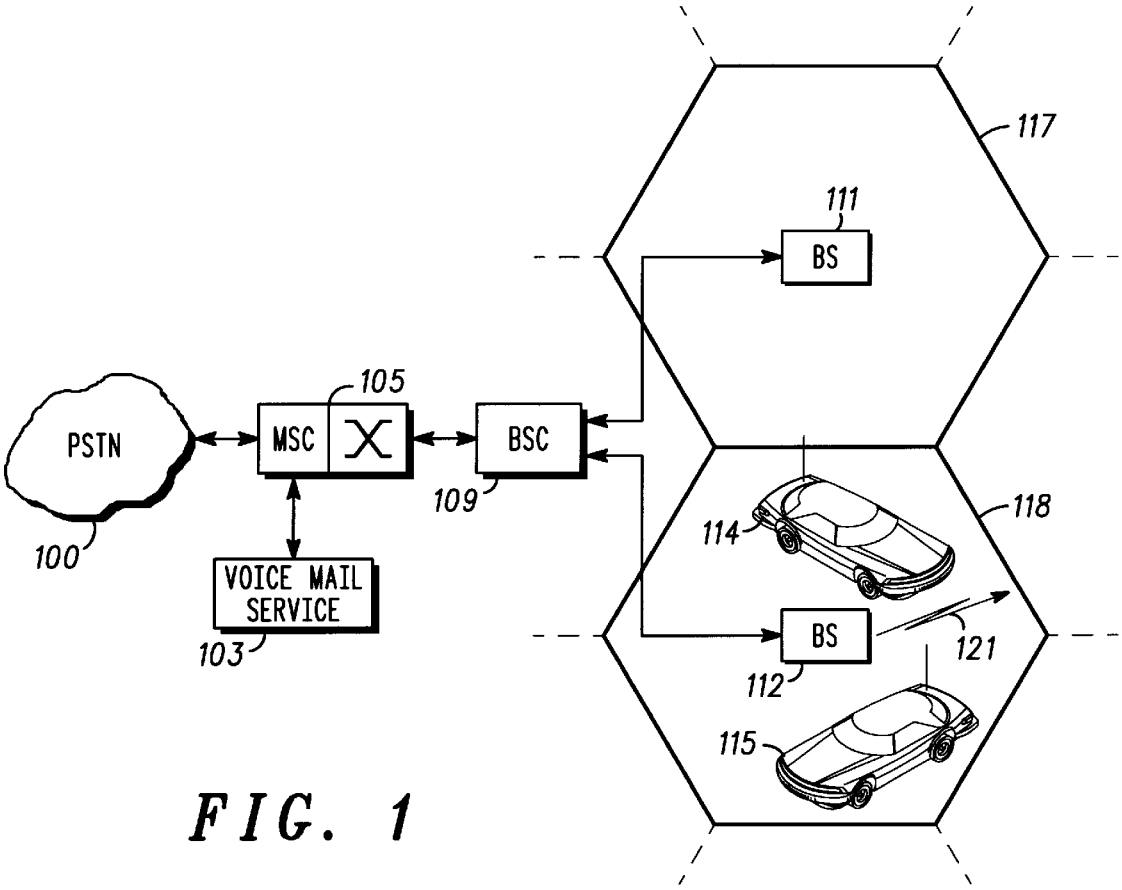
FIG. 1 generally depicts a digital cellular radiotelephone system which may beneficially employ the present invention.

A method and apparatus in a communication system is provided whereby the speech coding type/rate is adapted for tandem scenarios so as to avoid excessive speech degradation. When a tandem situation occurs, such as, inter alia, a voice mail system utilized in conjunction with a cellular radiotelephone system, the speech coding type/rate utilized is appropriately adjusted or selected so to reduce excessive degradation. While numerous embodiments to implement speech coding in accordance with the invention exist, the selection mechanisms can be grouped as either manual, semi-automatic, or automatic.

In an example of a manual selection mechanism, a voice mail system might be provided with several speech coding rates. A user in a digital cellular radiotelephone system might be instructed to press a keypad sequence which would be detected by the voice mail system. The keypad sequence entered by the user would be utilized to indicate how to appropriately code that user's message for storage.

In an example of a semi-automatic selection mechanism, a voice mail system may utilize a calling line identification (CLI) to determine the number from which it is being accessed. Using a database local to the voice mail system, the voice mail system can then determine if the source of the message is likely to be from a digital cellular radiotelephone user. If so, the voice mail system will appropriately select an enhanced (perhaps a higher rate or method) speech coding technique to code the user's speech at the voice mail system for digital storage.

In an embodiment incorporating an automatic selection mechanism, several different types of speech coders would be provided at the voice mail system. These different types of speech coders might be comprised of, inter alia, speech coders having different algorithms, complexities, and/or rates. Each of the different types of speech coders would code a user's input speech and, for each, determine a characteristic, or metric, for the particular speech input. For example, a quality characteristic may provide an estimate of the quality level of each of the speech coder's respective signal reconstruction ability. A quality characteristic might be signal to noise ratio (S/N), segmental S/N, perceptually weighted S/N, among numerous others well known in the speech coding art. A selection decision might then be made for the lowest rate coder whose quality characteristic exceeds a particular minimum threshold. In this way, a minimum acceptable quality level is established. The output coded speech of this selected speech coder is then stored in the voice mail system based on the assessment. In another embodiment, a signature analysis technique, capable of identifying the need for enhanced coding might also be beneficially employed to select the appropriate speech coder to use of the several tested. It is well known that certain speech coding techniques create speech artifacts. These speech artifacts may be detected using signature analysis techniques which provide a determination of the nature or type of coder which was used to create the speech input.

FIG. 1 generally depicts a communication system, and more specifically a digital cellular radiotelephone system, which may beneficially employ the present invention. As depicted in FIG. 1, a mobile services switching center (MSC) 105 is coupled to a public switched telephone network (PSTN) 100. MSC 105 is also coupled to a base site controller (BSC 109) which performs switching functions similar to MSC 105, but at a location remote with respect to MSC 105. Coupled to BSC 109 are base-stations (BS, 111, 112), which in the preferred embodiment, are capable of communicating with a plurality of mobile stations using frequency-hopped burst frequencies. Communication from a BS, and for clarity purposes BS 112, occurs on a downlink of a radio channel 121 to mobile stations (MS, 114, 115).

Also coupled to MSC 105 is voice mail service 103 which may beneficially employ the present invention.

Figure 2:
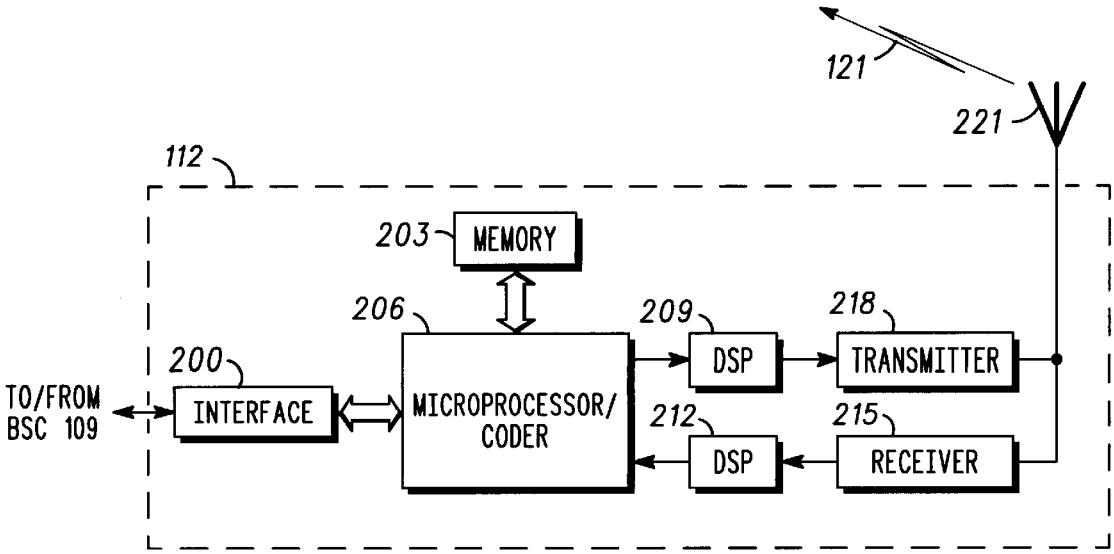
FIG. 2 generally depicts, in block diagram form, a base-station which may beneficially employ the present invention.

FIG. 2 generally depicts a base-station, and in this instance BS 112, which may also beneficially employ the present invention. The block diagram depicted in FIG. 2 also applies to BS 111 in the preferred embodiment. An interface 200 is coupled to block 206 and passes 64 kbps PCM speech data (as well as necessary control information) back and forth. Block 206 in the preferred embodiment contains, inter alia, a Motorola MC68000 microprocessor ($\mu$P) and a VSELP speech coder.

Figure 3:
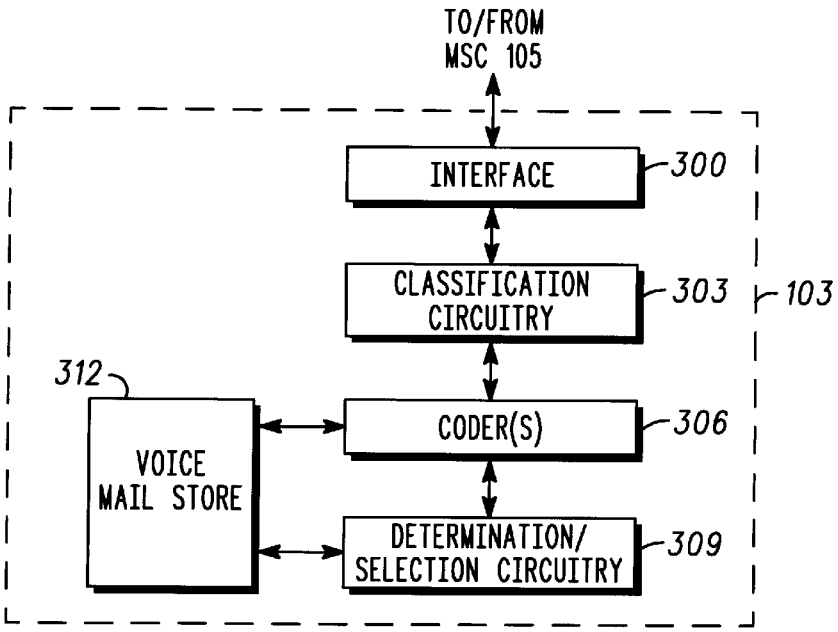
FIG. 3 generally depicts, in block diagram form, a voice mail system which may beneficially employ the present invention.
Figure 4:
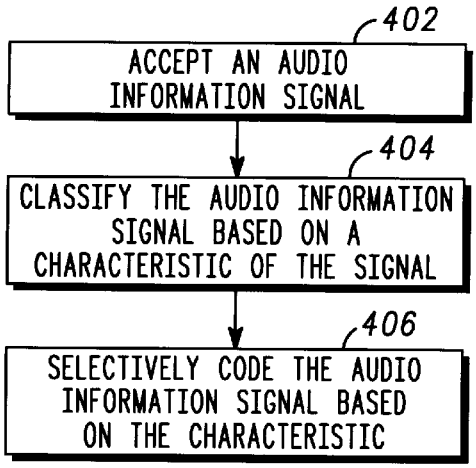
FIG. 4 generally depicts, in flow diagram form, a method of mitigating audio degradation in a communication system in accordance with a preferred embodiment of the present invention.

FIG. 3 depicts voice mail service block 103 which may beneficially employ the present invention. While the preferred embodiment is depicted as a voice mail service, one of ordinary skill in the art will appreciate that the method and apparatus of mitigating audio degradation in accordance with the invention may be beneficially employed at any area of the communication system which somehow alters, or codes, an audio information signal. Continuing, referring to FIG. 3 and FIG. 4, voice mail service block 103 is coupled to MSC 105 via interface 300. Interface 300 accepts the audio information signal 402 from MSC 105 in the form of 64 kbps PCM coded speech. In the preferred embodiment, audio information signal can be any audio signal, but is typically a speech signal of a particular user of the communication system. Interface 300 is coupled to classification circuitry 303 which classifies 404 the audio information signal based on the nature of the audio information signal. In the preferred embodiment, the nature of the audio information signal may be, inter alia, quality characteristics related to the audio information signal, the rate of previous coding of the audio information signal, the type of previous coding that the audio information signal has undergone and the source of the previous coding of the audio information signal. The source of the previous coding of the audio information signal may be further broken down into whether the source was an analog network or a digital network (typically the PSTN 100) and/or whether the source of the previous coding was the PSTN 100 or a wireless communication system such as a digital cellular radiotelephone system.

In its simplest implementation, classification circuitry 303 may be comprised of a Motorola MC56002 digital signal processor (not shown). While other techniques are available, determining the rate/type of previous coding and the source of previous coding of the audio information signal is best implemented by sending "header" information with the audio information signal specifying such. For example, one bit of a header may simply inform classification circuitry 303 whether the source of previous coding is an analog network or a digital network, while another bit may specify whether the source of previous coding is the PSTN 100 or a wireless communication system. In alternate embodiments, classification circuitry 303 may be capable of determining this information without the use of these header bits.

Referring back to FIG. 3, classification circuitry 303 is coupled to coder(s) block 306. Coder(s) 306 selectively codes 406 the audio information signal based on the classification performed by classification circuitry 303. While not shown in FIG. 3, coder(s) 306 consists of a plurality of different coders which perform a plurality of correspondingly different coding algorithms. The plurality of coding algorithms which may be used consist of, but are not limited to, waveform coding, linear predictive coding (LPC), sub-band coding (SBC), code excited linear prediction (CELP), stochastically excited linear prediction (SELP), vector sum excited linear prediction (VSELP), improved multi-band excitation (IMBE), and adaptive differential pulse code modulation (ADPCM) coding algorithms. Based on the classification of the audio information signal, coder(s) 306 may choose to code the audio information signal with any one of these coding algorithms, or may likewise choose to not code audio information signal at all and store it as 64 kbps PCM. In this situation, classification circuitry 303 would have determined that the signal is so corrupted that any further coding would substantially degrade the audio information signal beyond an acceptable limit. Output from coder(s) 306 is input into voice mail store 312, which simply stores the coded (or not coded) output of coder(s) 306. This selective coding, as previously stated, may be done automatically, semi-automatically or manually.

Figure 5:
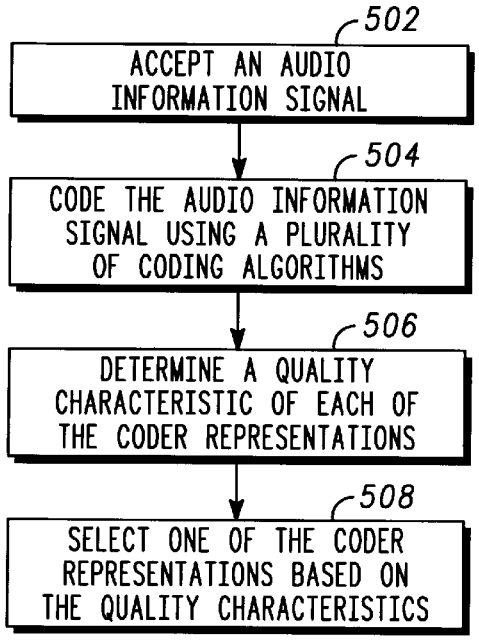
FIG. 5 generally depicts, in flow diagram form, a method of mitigating audio degradation in a communication system in accordance with another preferred embodiment of the present invention.

FIG. 3 also depicts an enhanced implementation of mitigating audio degradation in accordance with the invention. Referring to FIG. 3 and FIG. 5, interface 300 may accept 502 the audio information signal from MSC 105 and, without classification, simply code 504, via the plurality of coding algorithms within coder(s) 306, the audio information signal into a corresponding plurality of digitally compressed representations. In other words, each digitally compressed representation would correspond to an output from one of the plurality of coding algorithms. Output from coder(s) 306 would enter determination/selection circuitry 309 which would determine 506, for each of the digitally compressed representations exiting the respective coders, a quality characteristic of the respective codings. Determination/selection circuitry 309 would then select 508, based on the resulting quality characteristics of the respective codings, which of the digitally compressed representations to utilize for storage into voice mail store 312. In addition to the determination of the quality characteristic (for example, signal to noise ratio (S/N), segmental S/N, perceptually weighted S/N, among numerous others well known in the speech coding art), a compression efficiency characteristic of the respective codings may likewise be utilized in the selection process. A combination of the quality characteristic and the compression efficiency characteristic would give a more accurate overall estimate of which coding algorithm provides the most effective coding for the particular audio information signal analyzed.

As one of ordinary skill in the art will appreciate, the classification technique attempts to predetermine which type of coding should be utilized (if coding should occur at all) while the determination/selection technique allows the audio information signal to always be coded, and then make the determination on which to use. While both are depicted in FIG. 3, each may be implemented separately. For example, if the classification technique were only to be utilized, voice mail service block 103 would, at a minimum, be comprised of interface 300, classification circuitry 303, coder(s) 306 and voice mail store 312. If the determination/selection technique were utilized, voice mail service block 103 would, at a minimum, comprise interface 300, coder(s) 306, determination/selection circuitry 309 and voice mail store 312. In this implementation, coder(s) 306 would not be coupled to voice mail store 312 as shown in FIG. 3.

While the invention has been particularly shown and described with reference to a particular embodiment, it will be understood by those skilled in the art that various changes in form and details may be made therein without departing from the spirit and scope of the invention.

What I claim is:

1. A method of mitigating audio degradation in a communication system, the method comprising the steps of:

accepting an audio information signal;

classifying the audio information signal based on a characteristic of the audio information signal; and selectively coding said audio information signal according to a coding algorithm associated with the characteristic.

2. The method of claim 1 wherein said step of classifying the audio information signal comprises classifying the audio information signal based upon a quality characteristic selected from the group of, rate of previous coding of said audio information signal, type of previous coding of said audio information signal and a source of previous coding of said audio information signal.

3. The method of claim 2 wherein said step of classifying the audio information signal comprises classifying the audio information signal based upon a source of previous coding being either an analog network or a digital network.

4. The method of claim 2 wherein said step of classifying the audio information signal comprises classifying the audio information signal based upon a source of previous coding being either a public switched telephone network (PSTN) or a wireless communication system.

5. The method of claim 1 wherein said step of selectively coding comprises passing unchanged said audio information signal if said characteristic is indicative of previous coding of said audio information signal.

6. The method of claim 1 wherein said step of selectively coding further comprises the step of selectively coding said audio information signal using one of a plurality of coding algorithms.

7. The method of claim 6 wherein said step of selectively coding said audio information signal using one of a plurality of speech coding algorithms further comprises selectively coding said audio information signal using one of a plurality of coding algorithms from the group of coding algorithms consisting of waveform coding, linear predictive coding (LPC), sub-band coding (SBC), code excited linear prediction (CELP), stochastically excited linear prediction (SELP), vector sum excited linear prediction (VSELP), improved multi-band excitation (IMBE), and adaptive differential pulse code modulation (ADPCM) coding algorithms.

8. The method of claim 1 wherein said step of selectively coding is done automatically, semi-automatically or manually.

9. An apparatus for mitigating audio degradation in a communication system, the apparatus comprising:

means for accepting an audio information signal;

means, coupled to said means for accepting, for classifying the audio information signal based on a characteristic of the audio information signal; and means, coupled to said means for classifying, for selectively coding said audio information signal according to a coding algorithm associated with the characteristic.

10. The apparatus of claim 9 wherein said characteristic of the audio information signal comprises one of rate of previous coding of said audio information signal, type of previous coding of said audio information signal and a source of previous coding of said audio information signal.

11. The apparatus of claim 10 wherein said source of previous coding comprises one of an analog network or a digital network.

12. The apparatus of claim 10 wherein said source of previous coding further comprises one of a public switched telephone network (PSTN) or a wireless communication system.

13. The apparatus of claim 9 wherein said means for selectively coding is further operable for passing unchanged said audio information signal if said characteristic is indicative of previous coding of said audio information signal.

14. The apparatus of claim 9 wherein said means for selectively coding further comprises means for selectively coding said audio information signal using one of a plurality of coding algorithms.

15. The apparatus of claim 14 wherein said step of selectively coding said audio information signal using one of a plurality of speech coding algorithms further comprises selectively coding said audio information signal using one of a plurality of coding algorithms from the group of coding algorithms consisting of waveform coding, linear predictive coding (LPC). sub-band coding (SBC), code excited linear prediction (CELP), stochastically excited linear prediction (SELP), vector sum excited linear prediction (VSELP), improved multi-band excitation (IMBE), and adaptive differential pulse code modulation (ADPCM) coding algorithms.

16. The apparatus of claim 9 wherein said means for selectively coding is done automatically, semi-automatically or manually.

* * * * *